US011098870B2

(12) United States Patent
Garin et al.

(10) Patent No.: US 11,098,870 B2
(45) Date of Patent: Aug. 24, 2021

(54) LIGHTING MODULE FOR ILLUMINATION AND/OR SIGNALLING IN A MOTOR VEHICLE

(71) Applicant: VALEO VISION, Bobigny (FR)

(72) Inventors: Pascal Garin, Bobigny (FR); Stephane Andre, Bobigny (FR); Remi Letoumelin, Bobigny (FR)

(73) Assignee: VALEO VISION, Bobigny (FR)

( * ) Notice: Subject to any disclaimer, the term of this patent is extended or adjusted under 35 U.S.C. 154(b) by 74 days.

(21) Appl. No.: 16/201,377

(22) Filed: Nov. 27, 2018

(65) Prior Publication Data

US 2019/0162380 A1 May 30, 2019

(30) Foreign Application Priority Data

Nov. 27, 2017 (FR) ..... 17 61222

(51) Int. Cl.
*F21S 41/29* (2018.01)
*F21S 41/47* (2018.01)
(Continued)

(52) U.S. Cl.
CPC ..... *F21S 41/29* (2018.01); *F21S 41/143* (2018.01); *F21S 41/153* (2018.01); *F21S 41/19* (2018.01); *F21S 41/24* (2018.01); *F21S 41/322* (2018.01); *F21S 41/43* (2018.01); *F21S 41/47* (2018.01); *F21S 41/663* (2018.01); *F21S 41/365* (2018.01)

(58) Field of Classification Search
CPC ..... F21S 41/29; F21S 41/19
See application file for complete search history.

(56) References Cited

U.S. PATENT DOCUMENTS 8,157,414 B2 * 4/2012 Schaefer ..... F21V 5/007 362/245
2006/0133104 A1 * 6/2006 Okubo ..... F21S 41/143 362/545
(Continued)

FOREIGN PATENT DOCUMENTS

CN 104566215 A 4/2015
CN 105570794 A 5/2016
(Continued)

OTHER PUBLICATIONS

French Preliminary Search Report dated Jul. 3, 2018 in French Application 17 61222, filed Nov. 27, 2017 (with English Translation of Categories of Cited Documents).

*Primary Examiner* — Evan P Dzierzynski
(74) *Attorney, Agent, or Firm* — Oblon, McClelland, Maier & Neustadt, L.L.P.

(57) ABSTRACT

A lighting module for illumination and/or signalling in a motor vehicle includes a base supporting, on a first face, at least one light source that emits light rays, most of which extend along an optical axis perpendicular or substantially perpendicular to the first face, and a primary optical device including a receiving portion opposite at least one portion of the light source and an output face opposite the receiving portion. The lighting module has at least one arm projecting from the first face of the base and holding the primary optical device at a retaining zone positioned between the receiving portion and the output face of the primary optical device.

19 Claims, 4 Drawing Sheets

Figure 3:
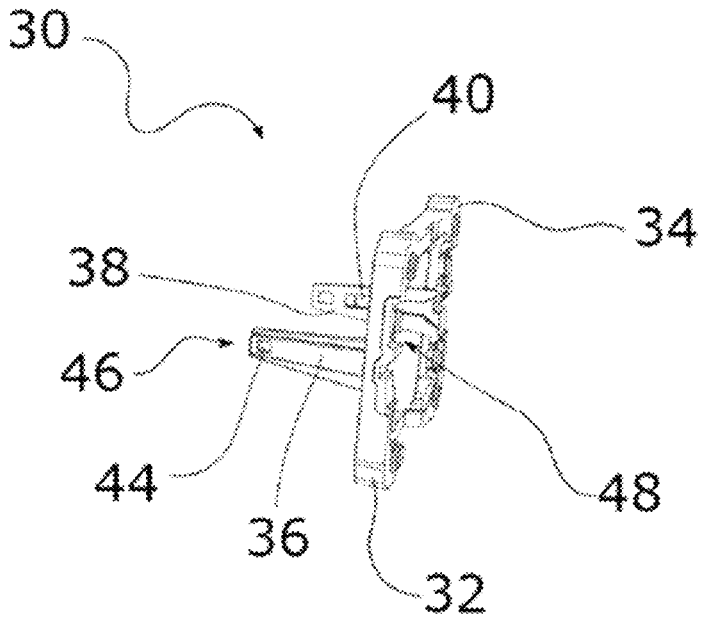

(51) Int. Cl.

| | |
|---|---|
| ***F21S 41/19*** | (2018.01) |
| ***F21S 41/43*** | (2018.01) |
| ***F21S 41/32*** | (2018.01) |
| ***F21S 41/153*** | (2018.01) |
| ***F21S 41/143*** | (2018.01) |
| ***F21S 41/663*** | (2018.01) |
| ***F21S 41/24*** | (2018.01) |
| *F21S 41/365* | (2018.01) |

(56) References Cited

U.S. PATENT DOCUMENTS

2009/0016074 A1 1/2009 Dolson et al.
2012/0120667 A1* 5/2012 Schenkl ..... F21V 5/008 362/335
2013/0105850 A1* 5/2013 Komatsu ..... F21S 41/143 257/98
2014/0078762 A1* 3/2014 Adams ..... F21S 45/47 362/496
2014/0307458 A1* 10/2014 Brendle ..... F21S 41/143 362/516
2017/0291532 A1 10/2017 Dinant et al.
2017/0328535 A1* 11/2017 Yagi ..... F21S 41/255
2017/0370547 A1* 12/2017 Zhang ..... F21S 41/141
2018/0106445 A1 4/2018 Okubo
2018/0142854 A1 5/2018 Nakao et al.
2019/0063718 A1* 2/2019 Tessnow ..... F21S 45/40
2019/0145596 A1* 5/2019 Suetsugu ..... F21S 41/285 362/521

FOREIGN PATENT DOCUMENTS

DE 10 2010 023 359 A1 4/2011
WO WO 2016/186179 A1 11/2016
WO WO 2016/203945 A1 12/2016
WO WO 2018/024349 * 12/2016 ..... F21S 8/10

* cited by examiner

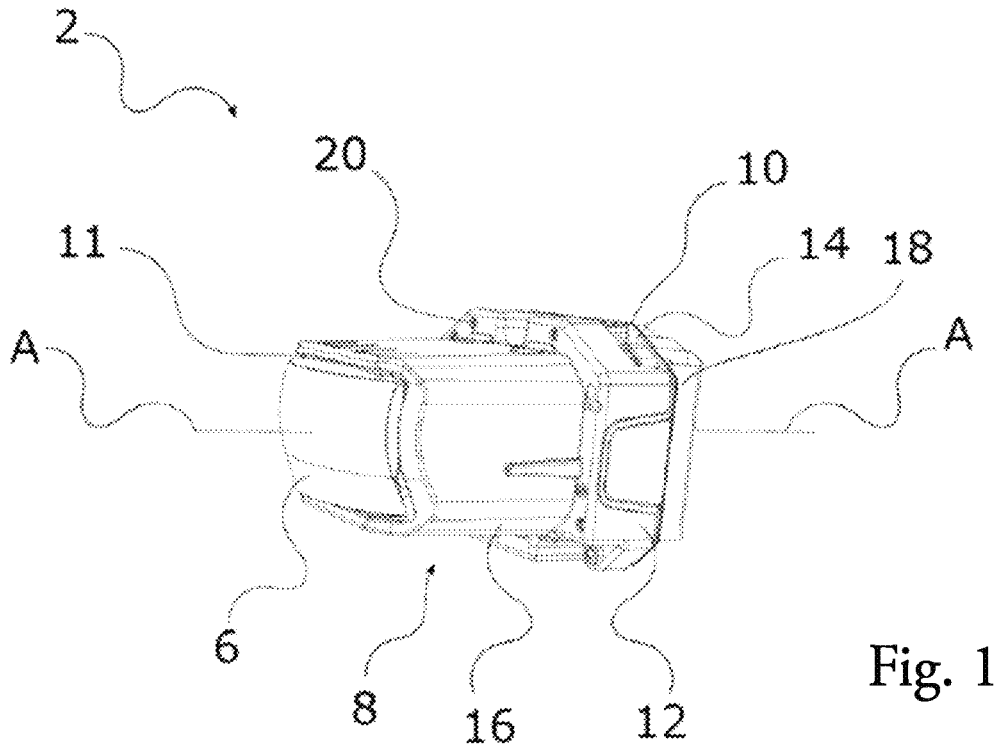
Fig. 1
Fig. 2
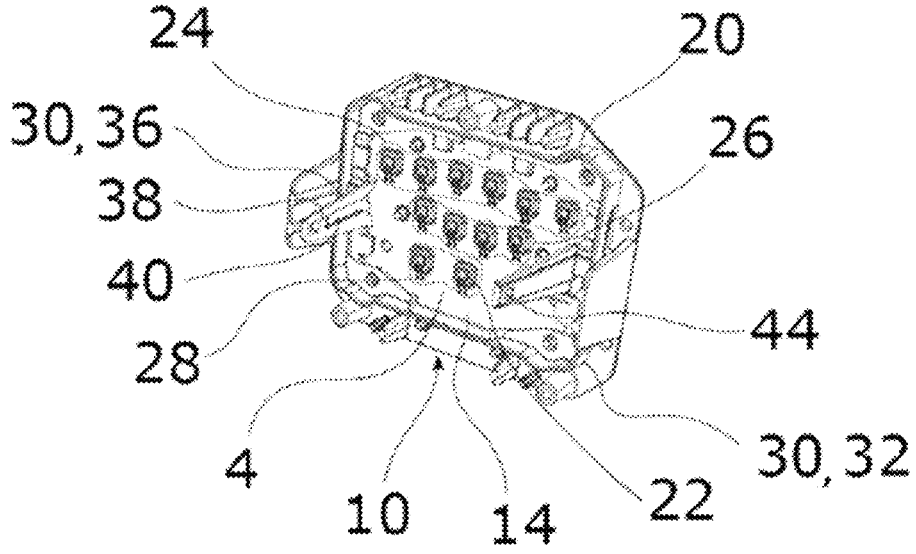

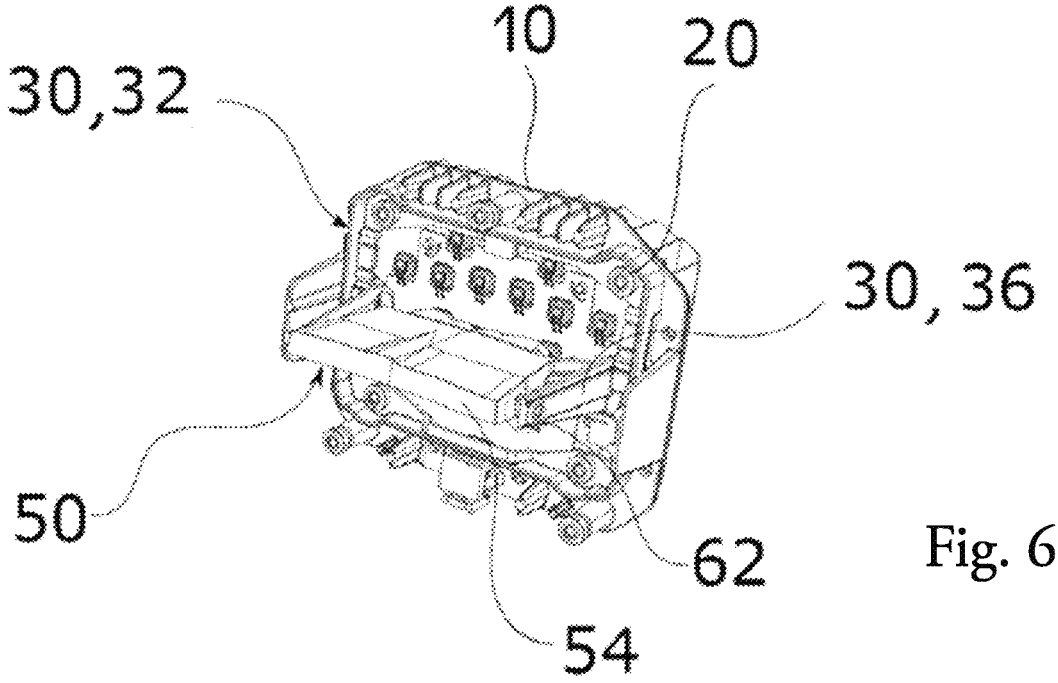
Fig. 6
Fig. 7
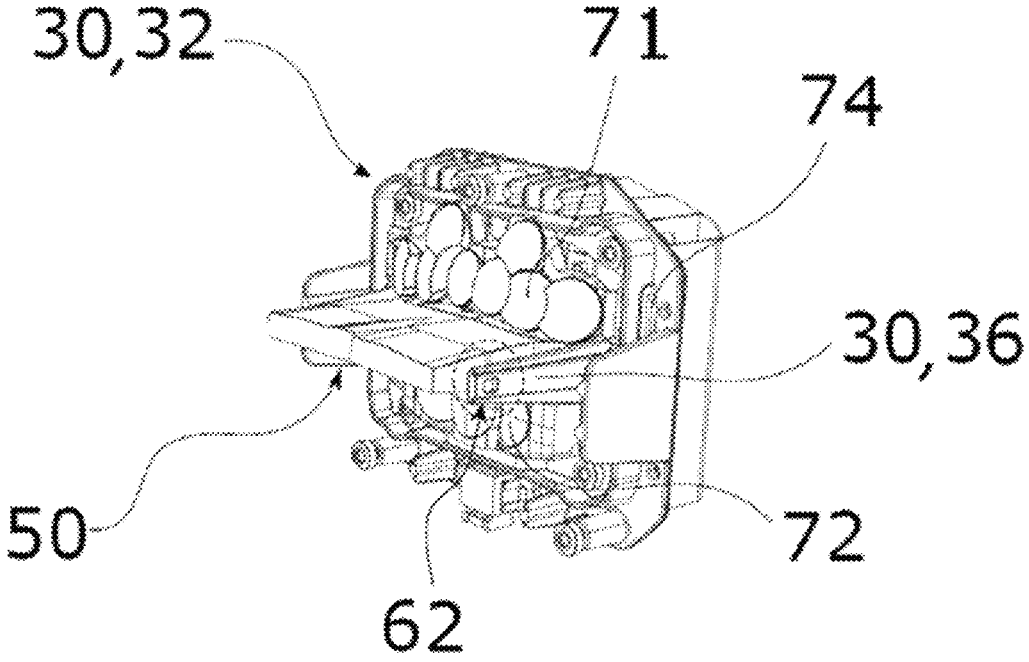

LIGHTING MODULE FOR ILLUMINATION AND/OR SIGNALLING IN A MOTOR VEHICLE

The present invention relates to the domain of lighting modules used for illumination and/or signalling in motor vehicles and applies more specifically to lighting modules including optical devices for forming different light beams, notably low beam and high beam.

Motor vehicle headlamps typically comprise a housing that is closed by a transparent wall through which one or more light beams pass. This housing contains at least one lighting module, comprising primarily a light source and an optical system designed to shape the light generated by the light source in order to perform the specific lighting and/or signalling functions of the vehicle. For example, the optical system can be designed to enable a low beam to be projected from the headlamp, notably to prevent drivers of vehicles traveling in the opposite direction from being dazzled.

To provide this low beam function, the lighting module has at least one light source, one primary optical device positioned opposite the light source to guide the light rays, a shield element that can interrupt the emitted light rays in order to form a partial light beam that does not dazzle third parties when projected from the headlamp, and a shaping lens for these rays to form the light beam coming out of the headlamp. The shield element is arranged in the path of the rays away from the light source, and it is beneficial for the position thereof to be ensured in the long term so that the shape given to the rays for the light beam referred to as low beam is stable over time.

Furthermore, additional lighting modules can be combined in a single headlamp to provide a high beam function that can illuminate a road over a long range, when there is no risk of dazzling third parties. These additional lighting modules also have one or more light sources and a primary optical device associated with a shaping lens to project the rays.

To improve compactness, there are lighting modules in which these two functions are provided, the light sources and the primary optical devices then having to be arranged in relation to one another to perform these different functions as a function of activation of one and/or another of the light sources. The first light sources are activated when low beam is required and the second light sources are activated additionally to project a beam in addition to this first beam to form a high beam by combining the two beams.

Such arrangements may involve using primary optical devices and/or a shield element that have a distal end face separated from a base supporting the light sources. The manufacturing clearances for such mass-produced primary optical devices can lead to positioning defects. A manufacturing defect in the base of the primary optical device, and notably where the base is attached to the support, may result in poor positioning of the device, especially if the overhang is large. Furthermore, the mechanical vibrations and temperature variations to which the lighting module is exposed during use can result, over time, in a variation in the inclination (greater or lesser) of these primary optical devices in relation to the light source. This inclination has the drawback of changing the area illuminated by the low beam, which can be uncomfortable or even dangerous for drivers of vehicles driving in the opposite direction. It is therefore necessary to regularly maintain the lighting module to correct this defect and prevent accidents.

The invention proposes a lighting module comprising a primary optical device in which the position in relation to the light source of the lighting module is less likely to change over time.

For this purpose, the invention relates to a lighting module for illumination and/or signalling in a motor vehicle, comprising a base supporting, on a first face, at least one light source that emits light rays, most of which extend along an optical axis perpendicular or substantially perpendicular to the first face, and a primary optical device comprising a receiving portion opposite at least one portion of the light source and a ray output face opposite the receiving portion. The terms "receiving portion" and "output face" shall be understood to mean the portion of the primary optical device illuminated by the light source and the face of the primary optical device used to direct this light towards a shaping lens, respectively.

The lighting module according to the invention is noteworthy in that it has at least one arm projecting from the first face of the base and holding the primary optical device at a retaining zone positioned between the receiving portion and the output face of the primary optical device. This enables the inclination of the primary optical device in relation to the base to be limited or prevented, thereby ensuring a reliable position of the primary optical device in the lighting module.

According to different features of the invention, taken individually or in combination:

- The arm may be arranged to face a lateral face of the primary optical device.
- The retaining zone can be closer to the output face than the receiving portion of the primary optical device. Preferably, the centre of the retaining zone is positioned at a distance from the emission face that is equal to or less than one quarter of the distance separating the receiving and emission faces of the primary optical device, preferably at a distance equal to or less than one eighth of this distance.
- The arm and the primary optical device have matching members that cooperate in said retaining zone. The members are matching in that the shape thereof enables cooperation that prevents the primary optical device from moving in relation to the arm.
- The matching members are an opening formed on an inner face of the arm opposite the primary optical device and a lug formed on a lateral face of the primary optical device. According to a variant embodiment, the arm may have an appendix on the inner face thereof that is designed to fit into a notch in a lateral face opposite the primary optical device.
- The arm has a groove formed in an inner face opposite the primary optical device to help guide the primary optical device along the arm during assembly thereof.
- The opening extends the groove.
- The arms are flexible enough to move apart to facilitate cooperation of the matching members, and notably to enable the lug to move from the groove to the opening. The groove can be delimited by an inclined plane at the opening, such as to facilitate the movement of the lug out of the groove.
- The lighting module has at least one chassis rigidly connected to the base, the chassis including the arm or arms.
- The chassis forms a frame extending partially about the light source. In this context, the lighting module may have at least two distinct chassis positioned such as to hold the primary optical device at two opposing faces.

The chassis forms a frame extending entirely about the light source.

The frame of the chassis is in contact with the first face of the base, the arms extending from the frame opposite said first face of the base.

The frame is held against the first face of the base by means of reversible attachment means, for example screws. According to a variant embodiment, the frame is glued against the first face of the base. The frame may also be assembled by material deformation, such as crimping and snap-riveting, without thereby moving outside the context of the invention.

The arm or arms are integrally formed with the base such as to form a one-piece assembly. One-piece assembly means that the arms and the base are rigidly connected to and integral with one another, and can only be separated from one another by damaging and breaking one or both of said components.

At least one arm has, in the vicinity of the free end thereof, a slot shaped and dimensioned to match the shape and dimensions of a bar projecting from the lateral face of the primary optical device.

The primary optical device has at least one strut extending a guide member of the primary optical device, said strut having a foot provided with a pin designed to cooperate with an orifice formed in the base.

The light source has at least one light-emitting diode that is pressed against the base, either directly or via a heat-conducting paste, and at least one electrical conductor linking the light-emitting diode to an electricity source. The heat-conducting paste can for example be a thermal adhesive or glue.

The light source includes at least one first light-source sub-assembly and one second light-source sub-assembly, an additional primary optical device being arranged to face the first light-source sub-assembly and the primary optical device being arranged to face the second light-source sub-assembly.

The additional primary optical device has at least one retaining foot projecting from the body of the device.

The frame has a first face arranged against the first face of the base, said first face having at least one notch designed to receive a retaining foot of the primary optical device or the additional primary optical device.

The primary optical device and/or the additional primary optical device is held against the first face of the base by the frame of the chassis.

The chassis is made of a heat-conducting material. According to one example, this material is a metal or a synthetic heat-conducting material.

The invention also covers a motor vehicle headlamp including at least one lighting module as described in the present document, in the most limited embodiment thereof or including one or more of the features set out above.

Figure 4:
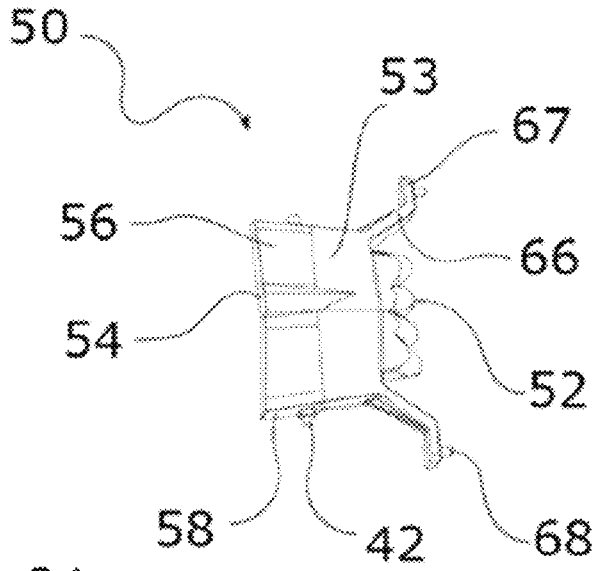
Figure 5:
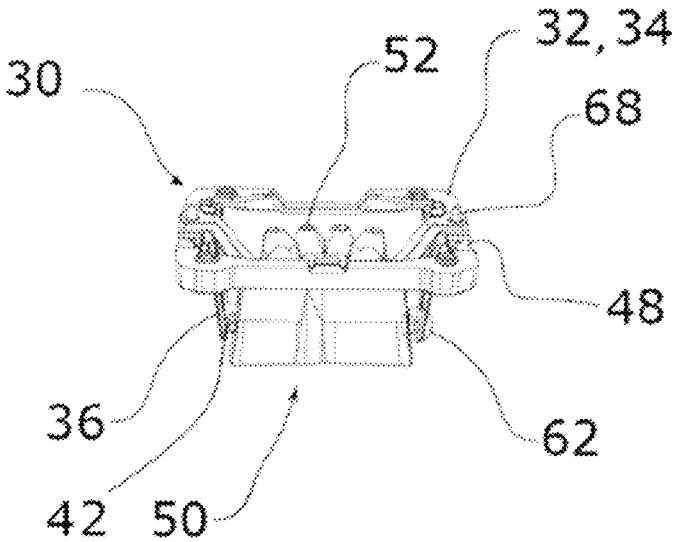
Figure 8:
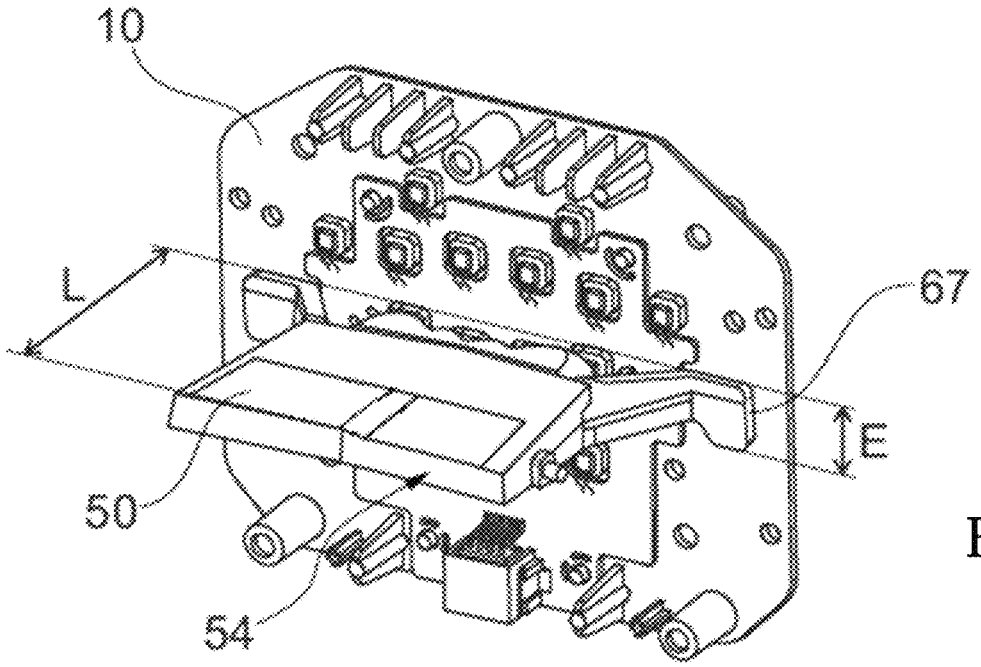
Figure 9:
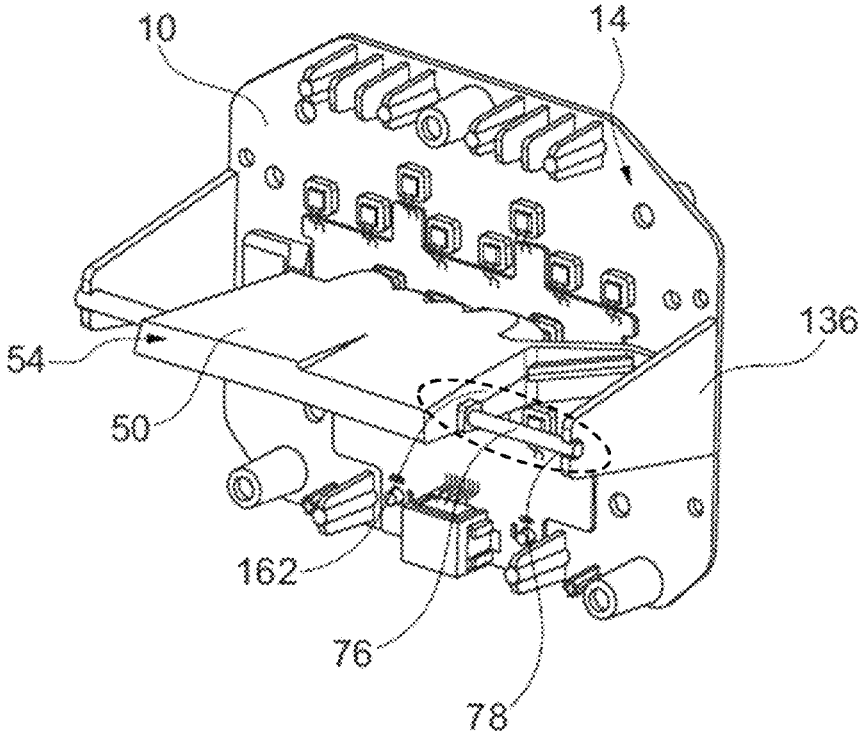

Other features, details and advantages of the invention are set out more clearly in the description given below by way of example and in relation to the drawings, in which:

FIG. 1 is a perspective view of a lighting module according to the invention, showing in particular the base, a support and a shaping lens, FIG. 2 is a partial perspective view of a lighting module as shown in FIG. 1, in which notably the support and the shaping lens have been removed to better show the base and the light source on the base, as well as a chassis designed to cooperate with a primary optical device (not shown here), FIG. 3 is a perspective view of the chassis of the lighting module in FIG. 2, FIG. 4 is a perspective view of a primary optical device designed to be fitted to the lighting module in FIG. 2, notably to form an assembly with the chassis in FIG. 3, FIG. 5 is a perspective view of an assembly formed by the primary optical device in FIG. 4 inserted into the chassis in FIG. 3, FIG. 6 is a view similar to FIG. 2, showing the assembly in FIG. 5, formed by the chassis and the primary optical device, mounted on the base of the lighting module, FIG. 7 is a perspective view of the lighting module in FIG. 1, in which the additional primary optical devices are shown in addition to the elements in FIG. 6, FIG. 8 is a perspective view similar to FIG. 6 in which notably the chassis has been removed, and FIG. 9 is a view of a second embodiment according to a perspective similar to the perspective in FIG. 6.

It should first be noted that the figures show the invention in detail to enable the invention to be carried out, and these figures may naturally be used to better define the invention where appropriate.

In the remainder of the description, the terms longitudinal or lateral, top, bottom, front and rear shall refer to the orientation of the lighting module 2 as intended to be incorporated into a front headlamp of a motor vehicle. A longitudinal direction corresponds to an optical axis A along which most of the light rays generated by the lighting module 2 extend. The lateral orientation corresponds to a straight line perpendicular to the optical axis A that extends horizontally. Finally, the vertical direction is an orientation perpendicular to the optical axis A and to the lateral orientation.

FIG. 1 shows a lighting module 2 according to the invention, also known as an optical module, the function of which is to generate and project one or more light beams onto a road. Such a lighting module 2 is designed to be installed in a headlamp of a motor vehicle, which is not shown in the figures in order to facilitate comprehension of the invention. Overall, the aforementioned headlamp comprises a rear housing that is closed at the front by a transparent outer lens, said outer lens being traversed by the light rays created by the lighting module according to the invention. Such a headlamp can thus contain a plurality of lighting modules and at least one lighting module according to the invention in the internal volume thereof, as delimited by the rear housing and the transparent outer lens.

Such a lighting module 2 forms a single sub-assembly, i.e. an object that can perform a function with no input other than the electrical energy required for activation, and where applicable using a module for adjusting the electrical current to protect the module from overheating.

The lighting module 2 according to the invention is designed to create a low beam and a high beam. As explained in greater detail below, the lighting module 2 is designed such that the high beam is the combination of the low beam with an additional beam that illuminates above and/or below the low beam, the combination thus forming the high beam.

The lighting module 2 has at least one light source 4 that is in particular visible in FIG. 2. The lighting module 2 also includes a lens 6 that is arranged at one end of the module such as to be traversed by the light rays emitted by the light source 4. Such a shaping lens 6 helps to form the light beam sought, whether low beam or high beam. In other words, the shaping lens 6 forms a first longitudinal end of the lighting module 2.

FIG. 1 also shows a support 8 for the shaping lens 6 that has a substantially tubular shape and that is arranged between a base 10 and the shaping lens 6. The lens can be clicked directly onto the support or attached by means of an attachment ring 11 pressing the shaping lens 6 against a longitudinal end of the support 8. This support 8 also provides a mechanical reference for the position of the shaping lens 6 in relation to the light source 4 via the base 10, such as to guarantee a given position of the shaping lens 6 in relation to the light source 4.

The support 8 is notably formed by two longitudinally consecutive tubular sectors with different cross sections. A first tubular sector 12 bears against a first face 14 of the base 10 turned towards the lens, while a second tubular sector 16 extends the first tubular sector 12 and forms a receiving area for the shaping lens 6. The first tubular sector 12 can be flush with a dissipation member 18 that is designed to evacuate at least some of the heat generated by the light source 4 away from the lighting module 2. The support 8 can be rigidly connected to the base 10 using screws pressing the support 8 against the first face 14 of the base 10.

A first embodiment is described below with reference notably to FIGS. 2 to 8. FIG. 2 shows a portion of the lighting module 2, and notably the base 10 without the support 8 such as to facilitate comprehension of the arrangement, inside the lighting module 2, of the light source 4, which here comprises an assembly of components associated such as to form three sub-assemblies designed to provide a light beam successively or simultaneously. The light source 4 therefore comprises several light-emitting diodes 22 of the same or different colours. The light-emitting diodes 22 are in contact with the first face 14 of the base 10, either directly or by means of a heat-conducting paste.

According to the present example, the lighting module 2 has three rows of light-emitting diodes that are substantially parallel to one another. Each row thus forms a light-source sub-assembly, including a first light-source sub-assembly 24, a second light-source sub-assembly 26 and a third light-source sub-assembly 28. The arrangement shown is given by way of example, and the light-emitting diodes could for example be arranged to form three functional sub-assemblies without an arrangement of parallel rows being visible on the module.

The first light-source sub-assembly 24 is used to create the light rays for a first light beam that is a low beam, the second light-source sub-assembly 26 is used to create the light rays for an additional light beam forming, by addition to the first beam, a second beam that is a high beam, and the third light-source sub-assembly 28 is used to create the light rays intended to increase the intensity in a central zone around the edge of the second beam, i.e. the edge forming a junction with the first beam when the two beams are projected simultaneously.

In the example shown, the first light-source sub-assembly 24 has six light-emitting diodes 22 that are substantially aligned in a lateral direction. The second light-source sub-assembly 26 and the third light-source sub-assembly 28 have four and two light-emitting diodes 22 respectively, which are distributed in two substantially lateral lines, the second light-source sub-assembly 26 being positioned between the first light-source sub-assembly 24 and the third light-source sub-assembly 28.

Each of the light-source sub-assemblies 24, 26 and 28 is arranged against the first face 14 of the base 10, in a central zone on said first face 14, as shown in FIG. 2. This enables a peripheral zone about this central zone to be freed up to enable attachment of a chassis 30 according to one aspect of the invention.

The cooperation between the chassis 30, visible in particular in FIGS. 2 and 3, and at least one primary optical device 50 arranged to face a light-source sub-assembly, visible in particular in FIG. 4, is described below.

More specifically, the chassis 30 shown in FIGS. 2 and 3 includes a frame 32 delimiting a rectangular closed contour. The dimensions of the frame are such as to enable the frame to be positioned about the light source 4 and to be held against the first face 14 of the base 10 using screws 20. The light source 4 is thus surrounded by the frame 32. Naturally, the shape and the dimensions of the frame can be adapted as a function of the dimensions and the shape of the light source 4.

The frame 32 has a first face 34 that is designed to be pressed against the first face 14 of the base 10 when the frame is attached to the base.

The chassis 30 also has two arms 36 extending from the frame 32 towards the shaping lens 6 in a longitudinal direction or a direction normal to the plane defined by this frame 32. As a result, when the frame 32 is attached to the base 10, the arms 36 extend primarily perpendicular to this base 10. The arms 36 extend from the opposing edges of the frame 32 and are more specifically positioned at each end of the lateral line formed by the second light-source sub-assembly 26. The arms 36 respectively have an inner face 38 turned towards the opposite arm such that the inner faces 38 of the arms face one another. Each inner face 38 has a groove 40 extending over a portion of the arm 36. More specifically, each groove 40 opens out onto the first face 34 of the frame, as shown in FIG. 3. The grooves 40 are preferably identical and the dimensions thereof are designed to enable guidance of a lug 42 rigidly connected to the primary optical device that is described below. Each arm 36 also has an opening 44 at one distal end 46, the opening 44 being positioned as a longitudinal extension of the groove 40. The term "distal" shall be understood to mean the end of an arm 36 that is furthest away from the base 10 and the light source 4, and that is therefore closest to the shaping lens 6. The openings 44 pass through each arm 36 entirely. Each opening 44 is dimensioned to receive a lug 42, as mentioned previously, after being guided by a corresponding groove 40. Unlike the grooves 40, the openings 44 are intended to lock the lug in position along the inner face 38 of the arm 36.

It should be noted that the openings and the lugs are in this case an example embodiment of matching members arranged on the arms of the chassis and on the primary optical device 50, as described in greater detail below, these matching members being shaped to enable this positional locking. Once the lugs 42 have been inserted into the openings 44, as illustrated in FIGS. 5 to 7, a retaining zone 62 for holding the primary optical device 50 on the chassis 30 is created. The primary optical device 50 is then held perfectly by the arms 36 such as to prevent the primary optical device 50 from moving in relation to the chassis 30.

The retaining zone 62 is in this case formed in the vicinity of the distal end 46 of each arm, it being understood that the distance between said retaining zone 62 and the output face 54 may be more or less than illustrated. To ensure that the device is stable, it is nonetheless desirable for this retaining zone to be arranged closer to the output face 54 at the end of the guide member 53 of the primary optical device than to the receiving portion 52 of this primary optical device 50.

It should be noted that the chassis 30 has notches 48 on the first face 34 thereof, said notches being designed to delimit receiving spaces for the feet 74 that are rigidly connected to optical elements, as described below.

As mentioned above, a lighting module 2 according to the invention also includes at least one primary optical device 50, as illustrated in FIG. 4, that can be arranged directly opposite the light source 4, between same and the shaping lens 6. In the example shown, it is noteworthy that this primary optical device 50 is involved both in creating a high beam by guiding the light rays inside the optical device, and creating a low beam by interrupting the rays handled by another primary optical device. To do so, the primary optical device 50 has a receiving portion 52 for receiving the light emitted by the second light-source sub-assembly 26, and a guide member 53 that is arranged longitudinally and that has a ray output face 54 at the free end thereof, i.e. at the end opposite the receiving portion 52. The guide member 53 is tile-shaped and is delimited by the main faces 56 and the lateral faces 58, enabling the light emitted from the receiving portion 52 to be guided towards the output face 54 and towards the shaping lens 6.

As described below in greater detail, at least one main face 56, specifically the main face oriented towards the first light-source sub-assembly 24, can be provided with an opaque or reflective coating that is designed to interrupt the rays emitted by the first light-source sub-assembly 24.

It should be noted that the primary optical device 50 according to the invention also has two struts 66 extending a side face 58 on both sides of the receiving portion 52 respectively. Each strut 66 has a foot 67 at the free end thereof opposite the guide member 53, said foot forming an elbow and having a contact face with the first face 14 of the base 10. The foot 67 has a pin 68 projecting from this contact face, said pin 68 being designed to be inserted in an orifice formed in the first face 14 of the base 10 (not shown in the figures). Inserting the pins 68 into the base 10 facilitates positioning of the assembly formed by the pre-assembly of the frame 32 and of the primary optical device 5*o* on the base 10, while ensuring that the receiving portion 52 for the primary optical device 50 is correctly positioned in relation to the second light-source sub-assembly 26. The primary optical device 50 is then held against the first face 14 of the base 10 by means of the frame 32. By way of example, reference may be made to FIG. 8 to illustrate this pre-assembly position. The combination of cooperation between the pins 68 rigidly connected to the primary optical device and the base on one hand, and cooperation between the lugs 42 also rigidly connected to the primary optical device and the arms 36 of the frame 32 on the other hand enable optimum retention of the primary optical device in relation to the base and each of the light-source sub-assemblies.

Indeed, the operator need only hold the frame 32 against the base 10 using screws 20, as shown in FIG. 6, to ensure that the inclination and the position of the primary optical device 50 will not change over time in relation to the light source 4, regardless of the vibrations and temperature variations to which the lighting module 2 is subjected.

FIG. 7 shows an assembly of primary optical devices designed to be arranged opposite a light-source sub-assembly respectively, with additional optical devices arranged on either side of the primary optical device described above. These additional primary optical devices include a first additional primary optical device 71 that is arranged opposite the first light-source sub-assembly 24, and a second additional primary optical device 72 that is arranged opposite the third light-source sub-assembly 28. The first and second additional primary optical devices 71, 72 are for example collimators, each collimator being arranged to collect at least a portion of the light rays from the light sources and to redirect said light rays towards the shaping lens 6. It should be noted that these first and second additional primary optical devices 71, 72 can have retaining feet 74 that are designed to be inserted into the notches 48 that are formed in the first face 34 of the frame 32 in order to ensure the position thereof by clamping against the base 10 provided by said frame 32. The additional primary devices 71, 72 are held against the first face 14 of the base 10 by means of the frame 32 of the chassis 30.

A lighting module fitted with such an assembly of the optical devices notably enables the formation of a low beam by the emission of light rays through the first additional primary optical device 71, and the formation of a high beam by the simultaneous emission of light rays through each of the primary optical devices of the module. The tile-shaped primary optical device described above is used firstly to guide the light rays emitted by the second light-source sub-assembly 26 to the output face 54 and secondly to interrupt the rays propagating between the first additional primary optical device 71 and the shaping lens 6.

In the context illustrated in FIG. 7, it is doubly important to fix the position of the primary optical device 50 in relation to the base 10 carrying the light source to ensure that the additional beam generated by this primary optical device 5*o* is correctly positioned in relation to the optical axis A of the lighting module, and to ensure that the end edge for interrupting the beam is also correctly positioned in the path of the rays to form a legally compliant low beam.

The presence of the arm 36 and of the retaining means arranged between this arm and the primary optical device is necessary in this context in which the primary optical device is elongated such that the output face opposite the base 10 is arranged at a significant distance from this base. A significant distance means that the dimension between the base 10 and the output face of the primary optical device, also referred to as the length L of the primary optical device, is greater than the dimension of this primary optical device along any axis parallel to the plane defining the first face 14 of the base 10, for example the thickness E thereof as shown in FIG. 8.

The presence of at least one arm and the retaining means has been described above according to a first embodiment, but naturally other embodiments can be implemented, for example the second embodiment illustrated in FIG. 9.

This second embodiment differs from the foregoing in that the arms 136 are in this case integrally formed with the base 10 such as to form a one-piece assembly, instead of being carried by a separate chassis. The arm projects from the base at a greater distance from the primary optical device than when this arm is carried by a chassis designed to cover the feet extending this primary optical device. In the example shown, the arms are arranged on the base around the periphery of these feet, so as not to hinder attachment thereof to the base.

Consequently, to bring the arms 136 into cooperation with the primary optical device in the retaining zone 162, the primary optical device 50 has at least one bar 76 projecting from the lateral face 58 over a sufficient distance to engage in a slot 78 formed in the corresponding arm 136.

In the example shown, each arm 136 has one such slot 78 in the vicinity of the free end, each slot having a shape and dimensions matching the shape and dimensions of the bar 76 arranged to project from the lateral face 58 of the primary optical device 50.

The description above clearly explains how the invention enables achievement of the objectives set, notably proposing a lighting module ensuring the easier and more secure retention over time of primary optical device facing a light source and lighting module. Indeed, the use of a chassis according to the invention helps to ensure that the position and the inclination of the primary optical device in relation to the light source does not change over time as a result of vibrations and/or temperature variations to which the lighting module is exposed. It is for this reason that the lighting module according to the present invention is more secure in use. The description made of an element shall naturally apply to any other element of the same type and the scope of the invention includes all the equivalent elements.

The invention claimed is:

1. A lighting module for illumination and/or signalling in a motor vehicle, the lighting module comprising:

a base supporting at a first face at least one light source that emits light rays, which extend along an optical axis perpendicular to the first face; and a primary optical device including a receiving portion opposite at least one portion of the light source and an output face opposite the receiving portion, the first face being only partially covered by the primary optical device, wherein at least one arm is projecting from the first face of the base and holding the primary optical device at a retaining zone positioned between the receiving portion and the output face of the primary optical device, wherein the primary optical device has at least one strut extending a guide member of the primary optical device, said strut having a foot provided with a pin designed to cooperate with an orifice formed in the base.

2. The lighting module according to claim 1, wherein the at least one arm is arranged to face a lateral face of the primary optical device.

3. The lighting module according to claim 2, wherein the retaining zone is closer to the output face than the receiving portion of the primary optical device.

4. The lighting module according to claim 2, wherein the at least one arm and the primary optical device have matching members that cooperate in said retaining zone.

5. The lighting module according to claim 2, wherein the arm has a groove formed in an inner face opposite the primary optical device to help guide the primary optical device along the arm during assembly thereof.

6. The lighting module according to claim 1, wherein the retaining zone is closer to the output face than the receiving portion of the primary optical device.

7. The lighting module according to claim 1, wherein the at least one arm and the primary optical device have matching members that cooperate in said retaining zone.

8. The lighting module according to claim 7, wherein the matching members are an opening formed on an inner face of the arm opposite the primary optical device and a lug formed on a lateral face of the primary optical device.

9. The lighting module according to claim 8, wherein the opening extends a groove.

10. The lighting module according to claim 1, wherein the at least one arm has a groove formed in an inner face opposite the primary optical device to help guide the primary optical device along the arm during assembly thereof.

11. The lighting module according to claim 10, wherein an opening extends the groove.

12. The lighting module according to claim 1, wherein the lighting module has at least one chassis rigidly connected to the base, the at least one chassis including the arm or arms.

13. The lighting module according to claim 12, wherein the at least one chassis forms a frame extending partially about the light source.

14. The lighting module according to claim 13, wherein the frame of the at least one chassis is in contact with the first face of the base, the at least one arm extending from the frame opposite the first face of the base.

15. The lighting module according to claim 12, wherein the at least one chassis forms a frame extending entirely about the light source.

16. The lighting module according to claim 1, wherein the arm or arms are integrally formed with the base such as to form a one-piece assembly.

17. The lighting module according to claim 16, wherein at least one arm as is, in a vicinity of a free end thereof, a slot shaped and dimensioned to match the slot shaped and dimensions of a bar projecting from the lateral face of the primary optical device.

18. The lighting module according to claim 1, wherein the light source includes at least one first light-source sub-assembly and one second light-source sub-assembly, an additional primary optical device being arranged to face the first light-source sub-assembly and the primary optical device being arranged to face the second light-source sub-assembly.

19. The lighting module according to claim 18, wherein the primary optical device and/or the additional primary optical device is held against the first face of the base by a frame of a chassis.

* * * * *